United States Patent [19]

Young

[11] Patent Number: 4,501,658

[45] Date of Patent: Feb. 26, 1985

[54] METHOD OF CONDITIONING CLAY FOR FLOTATION USING IN SITU FERROUS ACTIVATOR

[75] Inventor: Raymond H. Young, Macon, Ga.

[73] Assignee: Freeport Kaolin Company, New York, N.Y.

[21] Appl. No.: 411,250

[22] Filed: Aug. 25, 1982

[51] Int. Cl.[3] ..... B03B 1/00

[52] U.S. Cl. ..... 209/5; 209/166

[58] Field of Search ..... 209/166, 167, 4, 5, 209/9

[56] References Cited

U.S. PATENT DOCUMENTS

| | | | |
|---|---|---|---|
| 2,569,680 | 10/1951 | Leck | 209/5 |
| 3,072,255 | 1/1963 | Greene et al. | 209/166 |
| 3,353,668 | 11/1967 | Duke | 209/10 |
| 3,450,257 | 6/1969 | Cundy | 209/166 |
| 3,462,013 | 8/1969 | Mercade | 209/5 |
| 3,655,038 | 4/1972 | Mercade | 209/5 |
| 3,701,417 | 10/1972 | Mercade | 209/5 |
| 3,861,934 | 1/1975 | Mallory et al. | 209/5 |
| 3,923,647 | 12/1975 | Petrovich | 209/166 |
| 3,979,282 | 9/1976 | Cundy | 209/166 |
| 4,186,027 | 1/1980 | Bell et al. | 106/288 B |

*Primary Examiner*—Bernard Nozick

*Attorney, Agent, or Firm*—Fisher, Christen & Sabol

[57] ABSTRACT

Method of treating a clay to remove therefrom titanium mineral impurities comprising the steps of mixing an aqueous clay with a collector for the titanium mineral impurities, a reducing agent, and, if needed, an activator preferably comprising a water-soluble ferrous salt; conditioning the resulting mixture of aqueous clay slurry, collector, reducing agent and activator to dissipate therein at least 25 horsepower hours of energy per ton of solids; subjecting the conditioned mixture to froth flotation and removing titanium impurities with the froth; and recovering clay having a reduced titanium minerals impurities content. The method includes the case where the activator is a ferrous salt formed in situ from iron impurities in the clay formed by adding said reducing agent in place of some or all of added activator.

17 Claims, No Drawings

METHOD OF CONDITIONING CLAY FOR FLOTATION USING IN SITU FERROUS ACTIVATOR

BACKGROUND OF THE INVENTION

1. Field of the Invention

The present invention relates to methods for treating clays such as kaolin for the purpose of brightening the clay and thus rendering it more valuable for use in industries such as the paper industry and the coatings industry and more particularly refers to methods of treating clay in which a clay slurry is conditioned with activators and conditioning chemicals and subsequently floated in an air flotation procedure.

2. Prior Art

In U.S. Pat. No. 3,979,282 it is recognized that ferrous iron is capable of acting as an activator when added as a water soluble salt in a clay conditioning and flotation procedure. There is no disclosure or suggestion, however, in this patent or in any other prior art of taking steps to prevent the oxidation of the added ferrous salt before or during the conditioning operation to the ferric condition. More specifically, the patent fails to disclose or suggest the use of a reducing agent prior to or during conditioning to ensure that the ferrous salt remains in the ferrous condition.

The importance of maintaining the ferrous salt in the ferrous condition was not previously recognized in the prior art. For example, U.S. Pat. Nos. 3,655,038 and 3,923,647 actually introduce hydrogen peroxide just prior to conditioning or flotation. Such procedure clearly results in the conversion of any ferrous compounds originally in the clay into the ferric compounds.

U.S. Pat. No. 3,072,255 discloses the sulfidization of a dispersed clay with $H_2S$ or $Na_2S$ followed by conditioning and floating the clay slip. The procedure of this patent could result in the formation of a ferrous sulfide which is water soluble and which decomposes in hot water and is not generally accepted as an activator useful in conditioning clay prior to flotation. After sulfidization, the patent teaches neutralization and conditioning with oleic acid followed by addition of an alkaline material and particulate material such as graphite, sulfur, charcoal and the like followed by additional conditioning. There is no provision in the patent for maintaining the ferrous condition of the iron during conditioning of the slip. In addition the process of this patent needs to add particulate matter in order to assist in the float, i.e. in order to assist in improving the brightness qualities of the clay. The shortcomings of this patent in achieving an adequate brightness are admitted in U.S. Pat. No. 3,353,668 which refers to the process as providing "clay which has been partially brightened" and categorizes the clay treated by the process of U.S. Pat. No. 3,072,255 in the same category as raw clay (col. 2, lines 69–col. 3, line 1).

Bell et al U.S. Pat. No. 4,186,027, while not referring to a flotation process, discloses the reduction of iron in clay to the ferrous form using sodium dithionite followed by filtering to separate the iron from the clay.

SUMMARY OF THE INVENTION

The calcium ion has been in use for many years as an activator in conditioning clay slurries for the removal by flotation of kaolin clay impurities. However, we have found that certain clays fail to respond to activation by the calcium ion. In an attempt to improve the response of the clays that fail, a series of chemical salts containing ions other than calcium have been tested as activators in the TREP process. Although certain heavy metal ions did improve the response of certain clays, they are unacceptable due to their toxic nature.

The most efficient metal ion having a non-toxic nature is the ferrous ion which already has been suggested as an activator (U.S. Pat. No. 3,979,282). However, the use of the ferrous ion is complicated by its ease of oxidation during the conditioning stage. Thus, excessive amounts are sometimes necessary which, in many cases, cause the flocculation of the slurry which results in an inferior conditioning of the clay slurry.

After many attempts to reduce the oxidation of the ferrous ion, it was discovered that a reducing substance, such as sodium dithionite, added to the slurry along with the ferrous salt maintains the iron ion in a reduced state during the conditioning stage of the TREP process. Later, it was discovered that if there are sufficient reducible iron ions initially in the clay, then only the reducing agent alone is necessary for activation and no added activator is needed.

The use of a ferrous ion activator under reducing conditions also improves greatly the response of those clays which ordinarily fail to be activated by the calcium ion. In addition, the use of the ferrous ion/reducing agent system also improves the response of those clays which ordinarily are activated with calcium ion.

One method of brightness improvement for clay is to reduce the ferric ion usually present in varying quantities to a ferrous ion by adding a chemical reducing compound. At the present time the majority of kaolin clay companies use sodium dithionite to accomplish this reduction of the ferric ion. The ferrous ion formed through the reduction is soluble in the aqueous phase of the slurry and can be removed by filtration; the iron content of the clay is thus lowered without flotation. Normally a sufficient quantity of the reducing agent is added to maintain the iron component remaining in the clay in a reduced form up to and past the filtration step.

Not all of the iron found in a clay sample can be reduced to the ferrous form. Therefore, a particular clay may have a high iron content much of which might not be readily reducible to the ferrous form needed for activation. Thus, total iron content of a clay does not provide an adequate indication of whether the clay can provide in situ sufficient ferrous iron for adequate activation or whether additional ferrous ion or other activator, e.g., calcium ion, need be added. I have found that the brightness difference of a clay sample—before and after treatment with sodium dithionite is a dependable measure of the reducible iron available in a particular clay. Such brightness differences are illustrated in the following Examples and are characterized in the following Examples as low, med., or high levels of reducible iron.

The novel method comprises the steps of:

(1) preparing an aqueous dispersion of clay, (2) optionally, bleaching the clay with an oxidative bleach, (3) adding a reducing agent capable of reducing ferric ion to ferrous ion, additional activator being added if needed, (4) conditioning the clay slurry for a time sufficient to dissipate therein at least 25 HPH of energy per ton of clay solids and allowing the temperature of the slurry to increase without regulation, and (5) subjecting the conditioned slurry to froth flotation, removing titanium impurities with the froth and recovering clay having reduced titanium impurity content.

In general, the aqueous dispersion of the clay feed contains any solids content that is convenient and economical to work with, e.g., at least about 20% solids, preferably from about 25% to about 70% solids. A solids content of about 30% to about 40% can be employed. The feed is prepared in the conventional manner by agitating the clay with water and a dispersing agent, e.g., a preferably sodium silicate dispersant composition. Normally, 0.05 to 0.5 percent by weight of the dispersing agent is used, based on the weight of dry feed.

The dispersion is then optionally treated with an oxidative bleach such as sodium hypochlorite, ammonium persulfate, or potassium persulfate; preferably potassium persulfate, which is available commercially under the trade name of "Oxone" from duPont and Co. The amount of oxidative bleach used is between 0.01% and 0.1% by weight based on the dry weight of the aqueous clay feed. The pH of the dispersion is then adjusted by the addition of alkaline reagents to a range of pH 4.5 to 7.0, with a pH of 6 to 7 being preferred. The oxidative bleach is allowed to react for at least about 15 hours, e.g., for 15 to 24 hours, before proceeding in the process. The resulting slurry is preferably screened through a 325 mesh sieve to remove impurities having a particle size larger than 44 micrometers e.s.d. Other oxidizing bleaches can be used including those water-soluble inorganic or organic compounds containing in the molecule readily available oxygen capable of bleaching, such as ammonium persulfate, potassium permanganate, hydrogen peroxide and the like.

The clay slurry then is mixed with a reducing agent capable of reducing at least a portion of the iron impurities in the clay slurry to the ferrous form. The reducing agent also prevents or retards the conversion of the ferrous form back to its more oxidized state. Many different types of suitable reducing agents are available including sodium dithionite, zinc dithionite, sulfur dioxide, sulfoxylates such as sodium formaldehyde sulfoxylate and the like. The amount of reducing agent used depends upon its potency, the severity of oxidizing conditions to which the slurry will be subsequently subjected and the amount of reducible iron available for conversion to the ferrous form. In general, 1 to 25 ppt of reducing agents, such as sodium or zinc dithionite, is satisfactory and 2.5 to 15 ppt are preferred.

If the clay slurry does not naturally contain sufficient iron that is reducible to ferrous form to provide an adequate level of activation, additional activator ion can be added, e.g., any of the alkaline earth ions including magnesium, calcium, strontium, or barium or any of the "heavy metal" ions such as ferrous iron (preferred), cupric copper, manganous manganese and zinc, in the form of a salt such as a chloride, nitrate, acetate, oxide, or mixtures of salts, preferably a water soluble ferrous salt, at a concentration in the range of 0.005% to 0.15% or more by weight of the dry feed (or 0.1 to 3 ppt of solids in the dispersion or slurry) preferably in the range of 0.01% to 0.075% by weight (0.2 to 1.5 ppt of solids in the slurry).

An anionic oleophilic collector reagent is also added to the dispersion before conditioning. Such collector reagents include fatty acids having 8 to 20 carbon atoms, oleic acid, linoleic acid, lauric acid, tall oil, red oil, coconut oil fatty acids, and sulpho-oleic acid. The preferred anionic collector is oleic acid. The collector reagent is added usually in the range of 0.005% to 1.5% by weight of dry feed (or 0.1 to 30 ppt of solids in the slurry), the preferred range being 0.01% to 0.5% (or 0.2 to 10 ppt of solids in the slurry).

Conditioning of the aqueous clay slurry is carried out after the addition of the reducing agent, activator ions, if any, and the collector. Conditioning is carried out by agitating the mixture of slurry, activator ions, and collector reagent for a period of time in the range of 5 minutes to 180 minutes. About 10 to 120 minutes is usually necessary. For optimum results a high intensity of mixing is preferred, such as that obtained with a "Kady Mill" manufactured by Kinetic Dispersion Corp., Buffalo, N.Y. The conditioning corresponds to an energy input of about 25 to 1000 HPH (horsepower hours) per ton of dry feed. An especially satisfactory apparatus is disclosed and claimed in copending application concurrently filed herewith by F. C. Bacon, Jr. and R. L. Brooks and entitled "High Intensity Conditioning Mill and Method".

The conditioned aqueous slurry can be prepared for flotation by the addition of a dispersing agent belonging to the group of polycarboxylate salts. The preferred dispersant is a water soluble polyacrylate salt added in the range of 0.05% to 0.3% by weight of dry feed (or 1 to 6 ppt of solids in the slurry) with 0.15% to 0.25% by weight of dry feed (or 3 to 5 ppt) being the preferred amount. The lithium salt of poly(acrylic acid) is preferred, although the sodium and ammonium salts also work well and the magnesium and potassium salts or mixtures of any of the above-mentioned salts can also be used. In connection with certain clays, particularly the coarse clays or dilute clay slurries, sodium silicate or polyphosphate salts, can be substituted for some or all of the polyacrylate salt deflocculants added after conditioning and before or during flotation. Acrylate salts having an average molecular weight of 500 to 10,000 (preferably 750 to 2400) are useful as dispersants in the method of this invention.

The conditioned slurry may or may not be diluted for flotation as desired. The pH of the conditioned slurry with the added dispersant is adjusted for optimum frothing which is in the range of 6.0 to 8.0; a preferred range is 7.2 to 7.8 for most kaolin clays, however, the pH for flotation is dependent on the original feed.

The preferred method for flotation in this invention does not require the addition of frothing aids such as frothing agents used in the prior art. The frothing is preferably conducted in a modified frothing cell having the design shown and described in copending application filed concurrently herewith by F. C. Bacon, Jr., and entitled "Froth Flotation Apparatus and Process". The flotation cells commercially produced by the Denver Co. and the Wemco Co. are also available.

The titanium dioxide impurities are removed with the froth and the resulting clay slurry is then recovered by flocculation, reductive bleaching, filtration and drying or by any other recovery technique. The clay slurry after flotation can be subjected to any desired subsequent treatment, e.g., fractionation, reductive bleaching, flocculation, filtration and/or drying.

The following examples serve to illustrate the flotation of kaolin clay and are given to aid in understanding the invention and should not be construed as limiting the invention. In the examples "ppt" means pounds of the reagent per ton of clay solids. The percent titanium dioxide was determined by X-ray fluorescence (XRF) and brightness was measured according to TAPPI Standard T-646 OX-75. All other parts and percentages are on a weight basis unless specified otherwise. Also, temperatures are on the Fahrenheit scale unless otherwise specified. The term TREP means titanium removal and extraction process pursuant to the invention.

EXAMPLES 1-3

Comparisons A-D

In each Example and Comparison, a clay slurry was made from clay mined in the Wilkinson County area or Sandersville area of Georgia. The clay had a particle size range of 79% of less than 2 μm e.s.d. (equivalent spherical diameter) in the slurry feed pumped to the plant.

Reagents Used

Oleic acid: U.S.P. Food Grade
Calcium chloride: Added as a 10% aq. solution
N-brand sodium silicate: Approx. 37.7% solids (aqueous)
Sodium polyacrylate: Approx. 43% solids (aqueous). MOLECULAR WEIGHT OF 1500.

Pretreatment of Feed

The clay slurry was treated with 4.4 ppt "N" brand Na silicate dispersing agent and then passed through a 250 mesh screen to remove mica, sand and other coarse particles. The feed slurry had a solids content of 32.5% and an initial pH of 6.7. The slurry was combined with 1 ppt Oxone (E. I. duPont product comprising potassium persulfate.) and the pH adjusted to 6.5 to 7.0 with aqueous NaOH. The nearly neutral slurry is then allowed to stand for approximately 15 to 24 hours before proceeding. This allowed time for the Oxone to operate on any oxidizable material in the crude. After Oxone treatment the pH of the slurry was generally 6.5 to 6.8, the pH at which conditioning should be initiated. (Slurries having a pH value as low as 6.1 can be TREPPED satisfactorily pursuant to this invention.)

Conditioning

The conditioning of the Oxone-treated feed slurry was carried out using the amount of $CaCl_2$ and oleic acid given above. The percentage levels are based on the use of anhydrous reagents. Conditioning was done in the Kinetic Dispersion Mill (KADY) using 2500 ml of a pretreated feed. The chemical level must be decided upon and the chemicals measured and ready for addition. The slurry was placed in the KADY mill cell and the impeller lowered into the cell. After lowering the impeller, the KADY mill was started and the reagents were immediately added.

The slurry was allowed to condition 20 minutes and the final temperature was approximately 180° F. The pH after conditioning should be in the range of 6.1 to 6.3.

Removal of Oleic Acid—$TiO_2$ Impurity Complex And Aftertreatment

The 2500 ml of conditioned slurry was placed in a Denver cell and diluted to 4 liters with tap $H_2O$. The solids were generally in the range of 20-30%. Sodium polyacrylate was added in the amount of 4 ppt as an after-conditioning dispersant. This was allowed to mix into the slurry for a few minutes before frothing was begun. After the polyacrylate addition, dilute HCl was added to lower the pH to a value of 6.2 to 6.5 and the frothing was begun. The Denver cell was operated at 1200 RPM for 45 minutes. As frothing continued, the pH was raised to a maximum value of 7.8 if necessary to improve the removal of impurities. All pH adjustments made during frothing were lowered with dilute HCl (4:1) or raised with dilute $NH_4OH$ (9:1).

After the impurities had been removed, the slurry was flocculated by addition of 10% $H_2SO_4$ to a pH of 3, bleached with 15 lbs./ton K-Brite (a commercial form of sodium dithionite), filtered and dried.

The TAPPI brightness was measured on a Martin-Sweets Brightness Tester and the $TiO_2$ analysis determined by X-ray fluorescence. As used in the following examples, "GEB" means TAPPI brightness. "Feed" means the clay slurry after dispersal with sodium silicate dispersant. "Unbl." means unbleached. "Bl" means bleached with the reductive bleach sodium dithionite as described above. "Diff. in GEB" means the difference in TAPPI brightness of the reductively bleached feed slurry as compared to unbleached feed slurry and is a measure of the amount of reductive iron in that feed slurry.

(1) Comparison of formed-in-situ ferrous ion activator with calcium ion activator and ferrous ion activator in clay samples having a medium iron level and showing poor response to $CA^{++}$ activation Feed—A fine sized Wilkinson County crude kaolin clay was used. It was dispersed with 4.4#/ton of "N" brand sodium silicate. Particle size analysis showed that 79% of the particles were below 2 μm. The feed slurry had a solids content of 32.5% and an initial pH of 6.7.

Comparison A—The feed slurry was conditioned with oleic acid and $CaCl_2$ as described above using the amounts and types of reagents listed below.—KADY Mill stirring for 20 minutes—transferred to a Denver flotation cell and frothed with air as described above. The product isolated in the manner of flocculation, bleaching, filtration, and drying described above. The product was analyzed for % $TiO_2$ and GEB was measured. The results are given in Table I in respect to Comparison A.

Reagents—Calcium Chloride—0.25#/ton Oleic Acid—2.5#/ton

Comparison B—Another portion of the feed slurry was conditioned as above-described but with the substitution of ferrous sulfate in the amount shown in Table I for the calcium chloride reagent. The slurry was treated in same manner as in (A) above. The results are given in Table I.

Example 1—A third run with another portion of the feed slurry was conditioned in the presence of 7.2 ppt of sodium dithionite—for reducing ferric ions to ferrous ions—the level of oleic acid remained the same in all runs. No added activator was used. The conditioned slurry was floated and the product isolated by the procedure given above. The results are given in Table I.

TABLE I

| Comparison or Example | Activator | Dosage (ppt) | % $TiO_2$ | GEB Unbl. | GEB Bl. | % $TiO_2$ Removed | Diff. in GEB |
|---|---|---|---|---|---|---|---|
| Comparison of $Ca^{++}$, Added $Fe^{++}$ and Formed-In-Situ $Fe^{++}$ Activation in Clay Having a Medium Reducibile Iron Level | | | | | | | |
| — | Feed | — | 1.73 | 86.4 | 88.0 | — | 1.6 |
| A | $Ca^{++}$ ($CaCl_2$) | .25 | 1.53 | — | 88.3 | 11.6 | |
| B | $Fe^{++}$ ($FeSO_4$) | .25 | 1.00 | — | 89.7 | 42.2 | |
| 1 | Sodium Dithionite | 7.2 | 1.11 | — | 88.8 | 35.8 | |

These results show the improvement achieved by using ferrous ion activators for this type of fine sized clay over that of using a calcium ion activator. This feed illustrates a type of clay that does not respond well to a $Ca^{++}$ activator. The use of sodium dithionite to generate a reduced iron activator suggests that the amount of reducible iron may be lower than 0.25#/ton. Example 1 illustrates the superiority of the in situ formation of iron which resulted in the removal of more than three times the amount of $TiO_2$ than was removed when the $Ca^{++}$ activator was used.

(2) Comparison of formed-in-situ ferrous ion activator with calcium ion activator in clay showing a good response to calcium activation but containing only low level of reducible iron Feed—A Sandersville crude clay dispersed with 2.7#/ton of "N" brand sodium silicate. The solids content was 37.8%.

Comparison C—The slurry was conditioned using the types and amounts of reagents given below in the manner described above and floated in a Denver cell to serve as a comparison sample. The product was isolated in the way described above. Results are given in Table II below.

Reagents—Calcium chloride—2.0 ppt; Oleic acid—5.0 ppt

Example 2—Another portion of the above-described feed was conditioned in the manner described above but had 7.5#/ton of sodium dithionite substituted for the calcium chloride reagent in Comparison C. The oleic acid level remained constant. The results of these two runs are given in Table II.

TABLE II

| Comparison or Example | Acitvator | Dosage (ppt) | % $TiO_2$ | GEB Unbl. | GEB Bl. | % $TiO_2$ Removed | Diff. in GEB |
|---|---|---|---|---|---|---|---|
| Comparison of $Ca^{++}$ Activation With Formed-In-Situ $Fe^{++}$ In A Low Reducible Iron Level Crude | | | | | | | |
| — | Feed | — | 1.56 | 85.7 | 86.5 | — | 0.8 |
| C | $Ca^{++}$ ($CaCl_2$) | 2.0 | .68 | — | 88.6 | 56.4 | |
| 2 | Sodium Dithionite | 7.5 | .85 | — | 87.2 | 45.5 | |

These results confirm that the reducible iron content is at a low level in this particular type of clay, as judged by the GEB difference between a bleached and unbleached sample of the feed, and therefore is not as efficient as the calcium ion in this case. By the same token, smaller amounts of added $Fe^{++}$ activator ion would be needed to raise the efficiency to and above that of the $Ca^{++}$ ion activator.

(3) Comparison of formed-in-situ ferrous ion activator with calcium ion activation in clays containing a high level of reducible iron Feed—A crude clay from the Sandersville area was dispersed with 2.1#/ton of "N" brand sodium silicate to give a slurry having a solids content of 37.6%.

Reagents—Calcium chloride—2 ppt; Oleic acid—5 ppt

Comparison D—The feed slurry was conditioned as described above using the types and amounts of reagents to furnish a comparison sample. The sample was isolated in the manner described above by flocculation, bleaching, filtering, and drying. The results are given in Table III.

Example 3—Another portion of the above-identified feed was conditioned as described above, substituting 7.5#/ton of sodium dithionite for the calcium chloride reagent. The conditioning, flotation, and isolation of the product were identical to the procedures described above. Results are given in Table III.

TABLE III

| Comparison or Example | Activator | Dosage (ppt) | % $TiO_2$ | GEB Unbl. | GEB Bl. | Removed % $TiO_2$ | Diff. In GEB |
|---|---|---|---|---|---|---|---|
| Comparison of $Ca^{++}$ Activation Formed-In-Situ $Fe^{++}$ In A Clay Having A High Level Of Reducible Iron | | | | | | | |
| — | Feed | — | 1.65 | 82.0 | 84.7 | — | 2.7 |
| D | $Ca^{++}$ ($CaCl_2$) | 2 | 0.44 | — | 89.7 | 73.3 | |
| 3 | Sodium Dithionite | 7.5 | 0.19 | — | 91.1 | 88.5 | |

The results shown in Table III show that sufficient reduced iron ion is formed in the conditioning stage of the process to significantly reduce the remaining $TiO_2$ level well below that obtainable with $Ca^{++}$ activation.

The use of an increased level of calcium ion in Comparison D to produce a result equivalent to that of the sodium dithionite in Example 3 was not possible, because an increase in the calcium ion level by 10% produced a flocculation of the slurry before the conditioning stage could be completed.

The examples given above show that a reduced iron ion can be formed in a clay slurry which will act as an activator for the highly colored $TiO_2$ impurity. The concentration of the formed-in-situ reduced iron activator is important and can be estimated by measuring the GEB (TAPPI) brightness of the feed before and after reductive bleaching. The larger the GEB difference, the more efficient is the formed-in-situ reduced iron as an activator.

What is claimed is:

1. A method of treating a clay containing titanium mineral impurities and reducible iron impurities to remove said impurities therefrom, said method comprising the steps of:

(a) mixing said clay in the form of an aqueous slurry having a solids content of clay of at least 25% by weight with a reducing agent which functions to reduce said reducible iron impurities to a water-soluble ferrous salt and which thereafter reduces said reducible iron impurities to a water-soluble ferrous salt which is an in situ activator for said titanium mineral impurities;

(b) conditioning a mixture of said aqueous clay slurry containing said water-soluble ferrous salt in situ activator and said titanium mineral impurities, a collector for the titanium mineral impurities in said clay, and sufficient activator for said titanium mineral impurities including said in situ activator at a pH below 7 and at a solids content of at least 25% by weight for a time sufficient to dissipate therein at least 25 horsepower hours of energy per ton of solids;

(c) subjecting the conditioned mixture to an air froth flotation process by passing air bubbles upwardly through the conditioned aqueous slurry and removing titanium impurities with the froth; and (d) recovering clay having a reduced titanium minerals impurities content.

2. Method as claimed in claim 1 wherein said conditioning step (b) is carried out in a conditioning vessel and the resulting conditioned clay slurry is transferred, without dilution, to a froth flotation device wherein steps (c) and (d) are carried out.

3. Method as claimed in claim 1 wherein said reducing agent is sodium dithionite.

4. Method as claim in claim 1 wherein said reducing agent is added in the amount of 2.5 to 15 ppt.

5. Method as claimed in claim 1 wherein said clay contains sufficient iron mineral impurities reducible to a ferrous salt and no additional activator for said titanium mineral impurities is added in step (a).

6. Method as claimed in claim 1 wherein said collector is oleic acid.

7. Method as claimed in claim 1 wherein said flotation step (d) is carried out initially at an acid pH and then at an alkaline pH.

8. Method as claimed in claim 1 wherein, prior to mixing said clay slurry with said collector, and reducing agent, said clay slurry is bleached with an oxidative bleach at a pH of about 6 to about 7.

9. Method as claimed in claim 8 wherein said oxidative bleach is potassium monopersulfate.

10. Method as claimed in claim 8 wherein, prior to oxidative bleaching, said clay slurry is dispersed with a dispersant.

11. Method as claimed in claim 10 wherein said dispersant is sodium silicate.

12. Method as claimed in claim 1 wherein, after said froth flotation (c), said slurry is flocculated and bleached with a reductive bleach.

13. Method as claimed in claim 12 wherein said slurry is flocculated with sulfuric acid and said reductive bleach is sodium dithionite.

14. Method as claimed in claim 12 wherein, before flocculation and reductive bleaching, said slurry is allowed to settle and is dewatered by decanting.

15. Method as claimed in claim 1 wherein an activator for said titanium mineral impurities is added in step (a).

16. Method as claimed in claim 15 wherein said collector is oleic acid and said added activator includes a water-soluble ferrous salt.

17. Method as claimed in claim 15 wherein said collector is oleic acid and said added activator includes calcium chloride.

* * * * *